US012325458B2

(12) United States Patent
Imhof et al.

(10) Patent No.: US 12,325,458 B2
(45) Date of Patent: Jun. 10, 2025

(54) INDEPENDENT RAIL TEST RELEASE MECHANISM

(71) Applicant: HITACHI RAIL STS USA, INC., Pittsburgh, PA (US)

(72) Inventors: Andrew Imhof, Pittsburgh, PA (US); Sheldon Adam Benton, Murrysville, PA (US); Barrett Swygert, Lexington, SC (US); David F. Byrne, Delmont, PA (US); William A. Chisholm, Jr., Washington, PA (US); Kevin McQuistian, East Brady, PA (US)

(73) Assignee: HITACHI RAIL STS USA, INC., Pittsburgh, PA (US)

( * ) Notice: Subject to any disclaimer, the term of this patent is extended or adjusted under 35 U.S.C. 154(b) by 853 days.

(21) Appl. No.: 17/546,282

(22) Filed: Dec. 9, 2021

(65) Prior Publication Data

US 2022/0177015 A1 Jun. 9, 2022

Related U.S. Application Data

(60) Provisional application No. 63/122,991, filed on Dec. 9, 2020.

(51) Int. Cl.

| | |
|---|---|
| ***B61L 5/10*** | (2006.01) |
| ***B61L 25/06*** | (2006.01) |
| ***B61L 27/53*** | (2022.01) |

(52) U.S. Cl.

CPC ..... *B61L 5/10* (2013.01); *B61L 25/06* (2013.01); *B61L 27/53* (2022.01)

(58) Field of Classification Search

CPC .... B61L 5/00; B61L 5/10; B61L 25/06; B61L 27/53

USPC ..... 246/158, 448, 452, 147

See application file for complete search history.

(56) References Cited

U.S. PATENT DOCUMENTS

| | | | | | |
|---|---|---|---|---|---|
| 429,193 | A * | 6/1890 | Hambay | B61L 5/10 | 246/147 |
| 720,067 | A | 2/1903 | Quintal | | |
| 1,014,095 | A * | 1/1912 | Roach | B61L 5/10 | 246/158 |
| 1,176,051 | A * | 3/1916 | Guinn | B61L 5/00 | 246/318 |
| 5,620,156 | A * | 4/1997 | Berggren | B61L 5/10 | 246/448 |
| 7,104,508 | B1 * | 9/2006 | Delaware | B61L 5/10 | 246/415 R |

(Continued)

FOREIGN PATENT DOCUMENTS

| | | | | |
|---|---|---|---|---|
| AT | 502042 B1 | 1/2007 | | |
| EP | 0457754 A2 * | 11/1991 | B61L 5/10 | |
| WO | 1997/045309 A2 | 12/1997 | | |

OTHER PUBLICATIONS

USPTO, "International Search Report and Written Opinion" for corresponding International (PCT) application No. PCT/US2021/072827, Mar. 18, 2022, 6 pp.

*Primary Examiner* — Zachary L Kuhfuss

(74) *Attorney, Agent, or Firm* — Eckert Seamans Cherin & Mellott, LLC

(57) ABSTRACT

A test release mechanism for a railway switch machine includes a block structured to attach to a lock box in order to move in conjunction with the lock box and a lift pin structured to be operable to selectively engage and disengage the block with a slide bar.

14 Claims, 11 Drawing Sheets

(56) References Cited

U.S. PATENT DOCUMENTS

| | | | | |
|---|---|---|---|---|
| 9,238,474 | B1 * | 1/2016 | Carpenter | B61L 5/02 |
| 2012/0305565 | A1 | 12/2012 | Hansen et al. | |

* cited by examiner

INDEPENDENT RAIL TEST RELEASE MECHANISM

CROSS REFERENCE TO RELATED APPLICATION

This application claims the benefit of U.S. Provisional Patent Application Ser. No. 63/122,991, filed Dec. 9, 2020, which is incorporated by reference herein.

BACKGROUND

Field

The disclosed concept relates generally to switch machines for railways, and in particular, to a test release mechanism to release a lock box from a slide bar for testing of a point detection function.

Background Information

The Federal Railroad Administration (FRA) requires testing of switch machines every 90 days maximum in railways to confirm that the point detection function of the machine is working properly and independent of its locking function. These functions normally occur in conjunction with one another so the point detection function must be isolated for this test.

Testing of the point detection function is performed by placing an obstruction gauge between the stock rail and the switch point, about 6" back from the tip of the switch point. The switch machine is then operated to close the switch point on the obstruction gauge. However, the internal locking mechanism in some designs includes lock rods that move in conjunction with movement of the switch point. The lock rods include notches on their upper and lower sides that correspond to lock dogs of a lock box. The upper and lower notches are offset linearly along the lock rods. The upper notches will only align with a corresponding lock dog when the switch points are in a normal position and the lower notches will only align with a corresponding lock dog when the switch points are in a reverse position, or vice versa. As a first stage of the switch operation, a slide bar connected to the lock box will move laterally, separating upper notches from their corresponding upper lock dog. In a second stage, the switch points are moved and the lock rods move in conjunction through the lock box. In the third stage, the slide bar is further moved laterally causing the lock box to move such that the lower lock dog slides into the lower notches. However, in normal operation, an obstruction between the switch point and stock rail that prevents the switch points from moving to fully closed will not allow the lock rods to slide far enough such that the lower lock dog and lower notches are aligned. Thus, the lock dog abutting against the lock rod, rather than being able to slide into the notches, will prevent the switch machine from being fully operated to its locked position. However, FRA testing of the point detection function requires that the switch machine must be fully operated to its locked position to validate that indication contacts are opened by the point detection function alone rather than by an incomplete movement of the locking mechanism, so as to ensure the safety/redundancy of the mechanism.

To validate compliance to the independence of the locking and indication, a prior solution involved loosening lock rod nuts of the lock rod connection so that the lock rods could be moved ½" manually, rather than in strict conjunction with the switch points. Once loosened, an operator could manually manipulate the lock rod enough so that its notches would align with the lock dogs and the switch machine could complete its cycle and verify that the indication contacts remain opened. However, after completion of the test, the operator would then need to restore the lock rod connections to their original state, including any necessary readjustments to ensure proper operation. However, for an experienced operator, the test process, including loosening the lock rods and then restoring them to their original state, could take 20-30 minutes, which is a significant effort for a regularly required test of a single switch machine. There is thus room for improvement in railway switch machine mechanisms to minimize the time to perform the described test.

SUMMARY

In accordance with aspects of the disclosed concept, a test release mechanism for a railway switch machine comprises a block structured to attach to a lock box in order to move in conjunction with the lock box; and a lift pin structured to be operable to selectively engage and disengage the block with a slide bar.

In accordance with aspects of the disclosed concept, a locking mechanism for a railway switch machine comprises: a lock box; a lock rod assembly passing through the lock box; a slide bar; and a test release mechanism including: a block structured to attach to the lock box in order to move in conjunction with the lock box; and a lift pin structured to be operable to selectively engage and disengage the block with the slide bar.

DESCRIPTION OF THE PREFERRED EMBODIMENTS

Figure 1A:
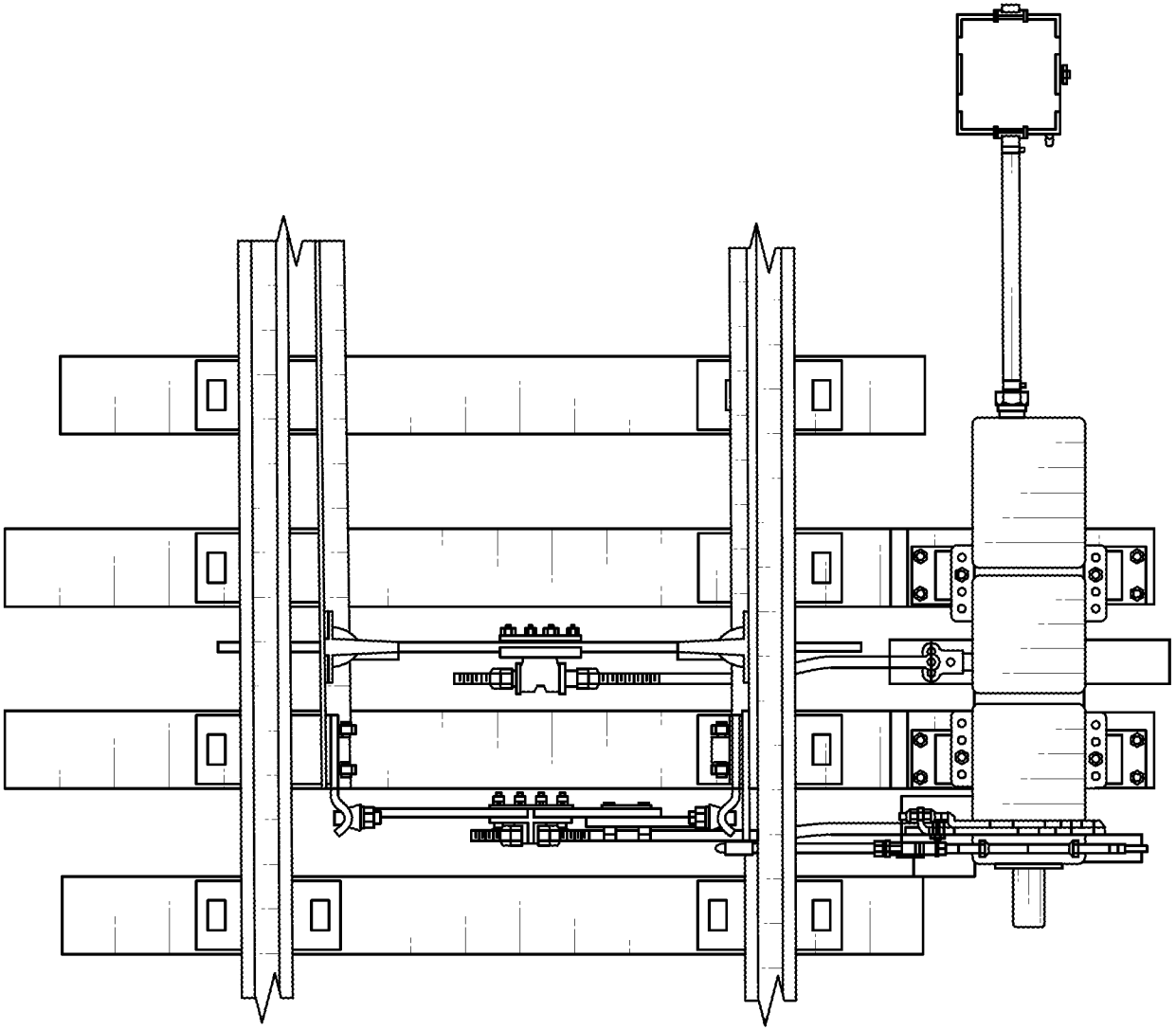
FIGS. 1A and 1B are views of a railway switch machine layout.

Directional phrases used herein, such as, for example, left, right, front, back, top, bottom and derivatives thereof, relate to the orientation of the elements shown in the drawings and are not limiting upon the claims unless expressly recited therein.

In accordance with an example embodiment of the disclosed concept, a test release mechanism is provided. The test release mechanism is a mechanism that provides for a quick release and subsequent securing of movement of a lock box to a slide bar in a locking mechanism of a switch machine for railways. When the test release mechanism releases movement of the lock box, the slide bar can move independent of the lock box. This allows the slide bar to be moved during a point detection function test without moving the lock box and preventing its lock dogs to interfere with the lock rods, even when the switch machine completes it cycle to the fully locked position. In this manner, the point detection function test is able to be completed without loosening the lock rod connections between the tracks or the external lock rod connecting points. Once the test is complete, the test release mechanism can be operated to quickly re-secure the lock box to the slide bar so that normal switching operations can continue. With the test release mechanism, proper testing of the point detection function of the switch machine can be completed quickly and easily. An example embodiment of the test release mechanism will be described in more detail herein with reference to the figures.

Figure 1B:
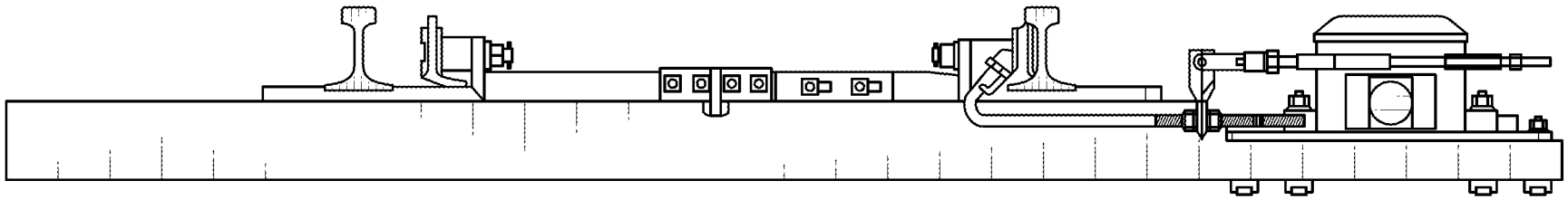

FIGS. 1A and 1B provide views of a typical switch machine layout connected to switch points of a railway system to provide background context. A locking mechanism including a test release mechanism applicable for use as part of a switch machine for a railway system in accordance with example embodiments of the disclosed concept will be described in more detail herein.

Figure 2:
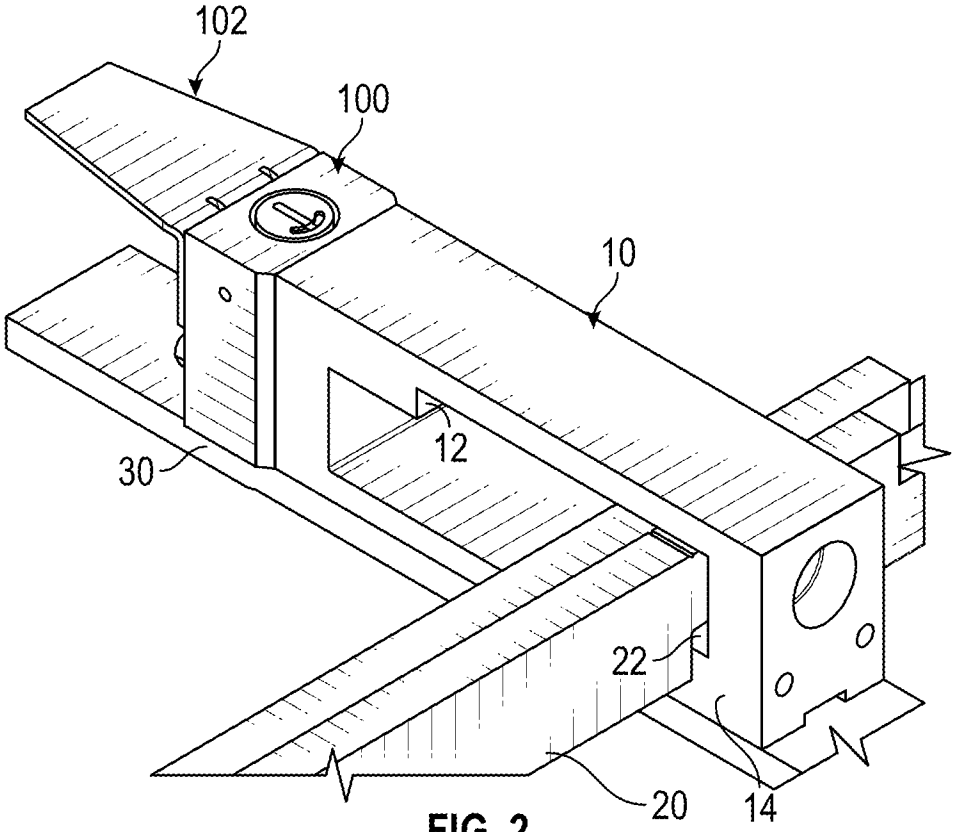
FIG. 2 is a view of a locking mechanism including a test release mechanism in accordance with an example embodiment of the disclosed concept.

FIG. 2 is a view of a locking mechanism including a test release mechanism 100 in accordance with an example embodiment of the disclosed concept. The locking mechanism may be part of a switch machine for a railway system such as, for example and without limitation, that shown in FIGS. 1A and 1B. The locking mechanism also includes a lock box 10 having an upper lock dog 12 and a lower lock dog 14. A lock rod 20 extends through the lock box 10. The lock rod includes a lower notch 22 and an upper notch (not shown) offset from the lower notch 22. The test release mechanism 100 is attached to the lock box 10 and is structured to selectively engage a slide bar 30. The test release mechanism 100 includes a guard 102 which will be described in more detail in associated with other figures. During normal operation, the test release mechanism 100 is engaged with the slide bar 30 such that the test release mechanism 100 and the lock box 10 move in conjunction with the slide bar 30. For testing the point detection of the switch machine, the test release mechanism 100 may be operated to release its engagement with the slide bar 30, thus allowing independent movement of the slide bar 30 with respect to the test release mechanism 100 and lock box 10. In a normal switching operation, the switch machine will first move the slide bar 30 laterally to disengage notches of the lock rod 20 from their corresponding lock dog. Next, the switch machine will move the switch points and the lock rod 20 will move in conjunction through the lock box 10. Finally, the switch machine will continue lateral movement of the slide bar 30 such that the other lock dog of the lock box 10, now aligned with the other notches of the lock rod 20, will slide onto the notches, thus locking the switch points into position.

For performing the point detection function of the switch machine, the test release mechanism 100 is operated to release it from the slide bar 30 and allow the slide bar 30 to move independent of the test release mechanism 100 and the lock box 10. Testing the point detection function of the switch machine requires an obstruction to be placed between the stock rail and the switch point, which also prevents the lock rod 20 from moving through the lock box 10 enough to align its notches with their corresponding lock dog, which would normally prevent completion of the final lateral movement of the slide bar 30 because the lock rod 20 would abut against the lock dog. However, since the slide bar 30 can now be moved independently of the lock box 10, the switch machine can complete its final lateral movement of the slide bar 30 even with the obstruction gauge in place. In an example embodiment of the disclosed concept, the test release mechanism 100 may be operated to pin the lock box 10 in a mid-throw position, where neither of its lock dogs interfere with the lock rod 20. From this position, the slide bar 30 can move laterally, without corresponding movement of the lock box 10, and the full range of movement of the slide bar 30 and lock rod 20 can be completed without any interference with the lock box 10. In this manner, the testing of the point detection function can be properly completed. After the test, the test release mechanism 100 can then be re-engaged with the slide bar 30 and normal switching operations can resume.

Figure 3A:
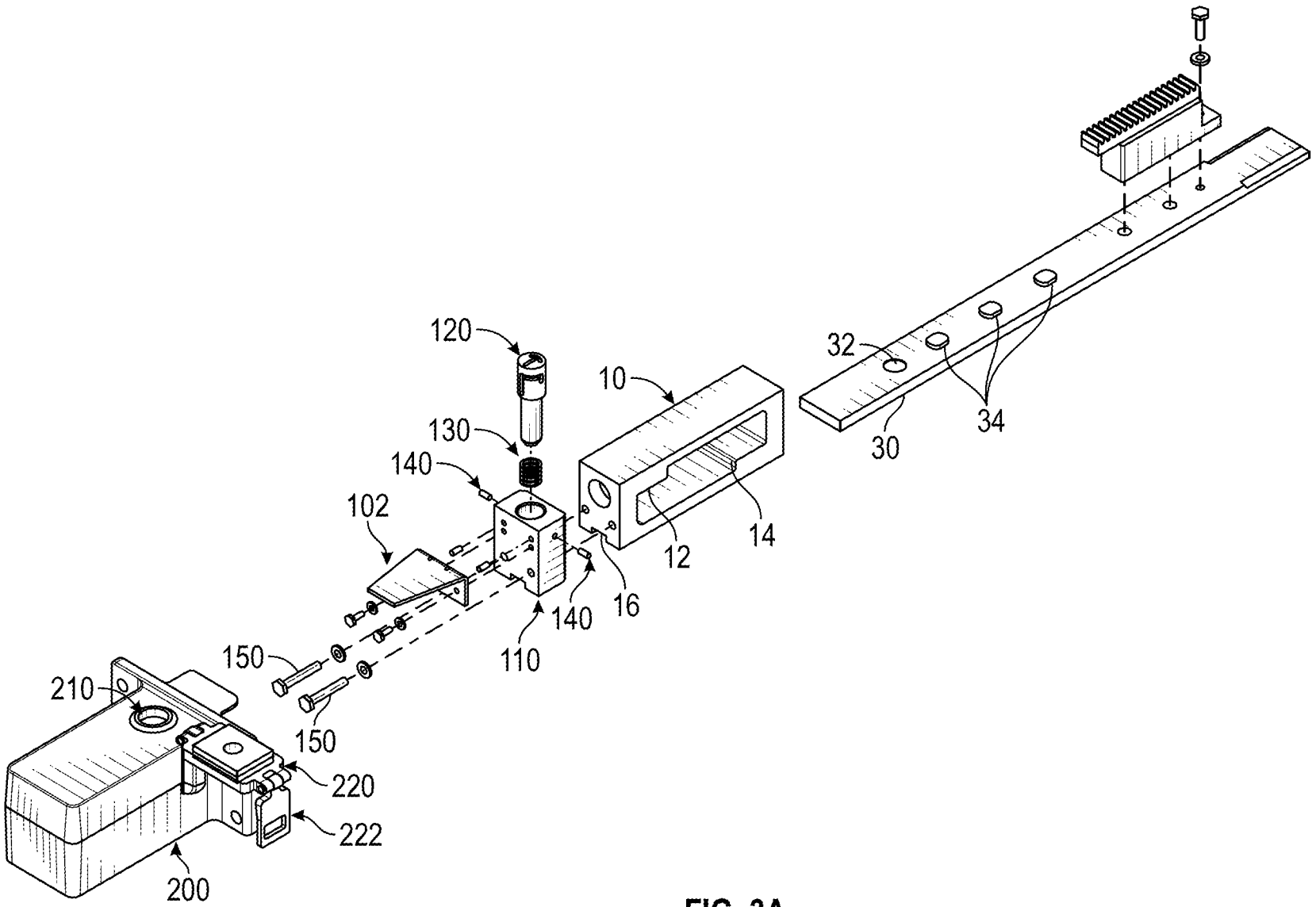
FIGS. 3A-E are additional views of a locking mechanism including a test release mechanism in accordance with an example embodiment of the disclosed concept.
Figure 3B:
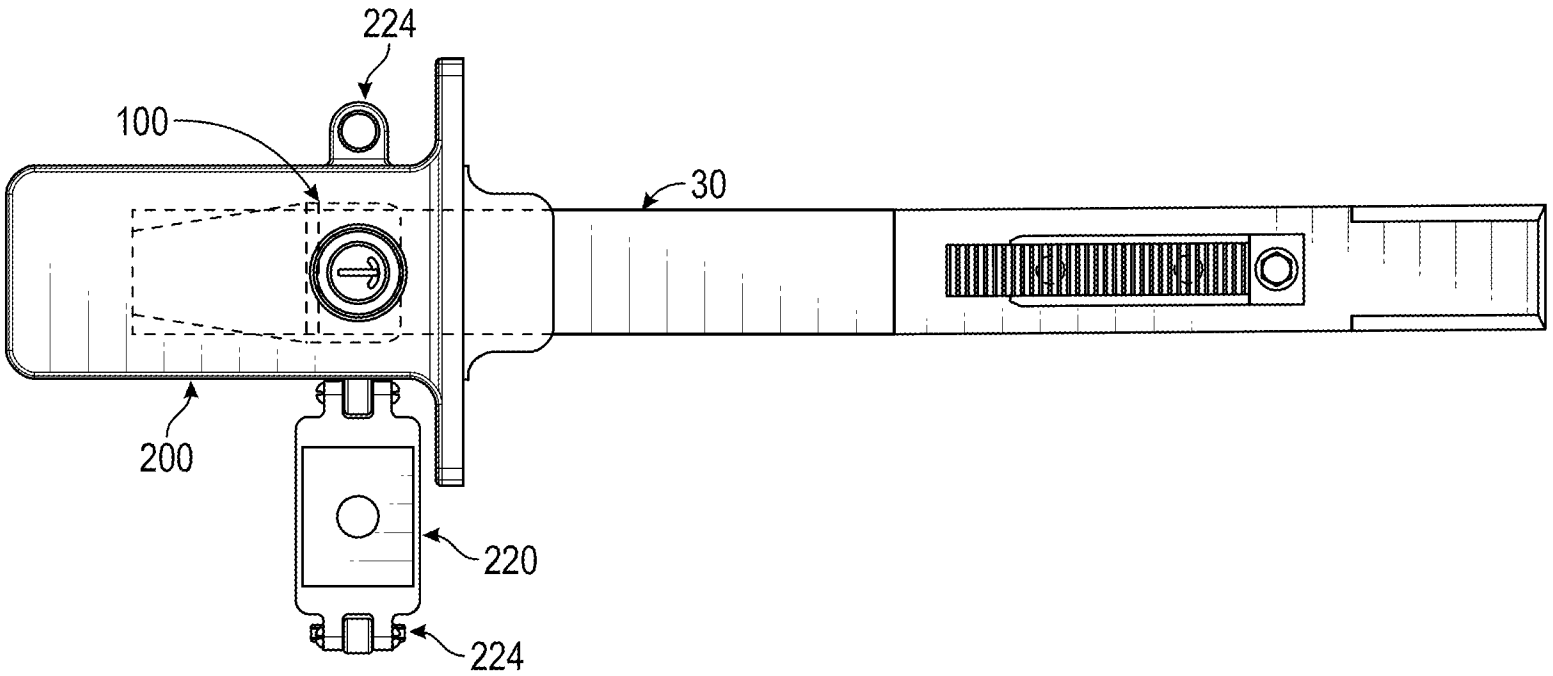
Figure 3C:
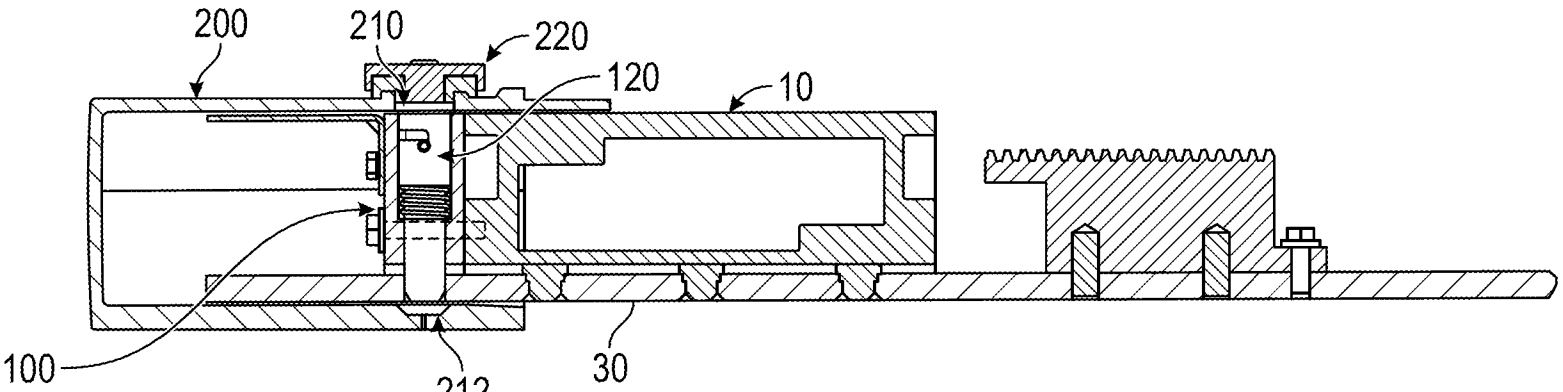
Figure 3D:
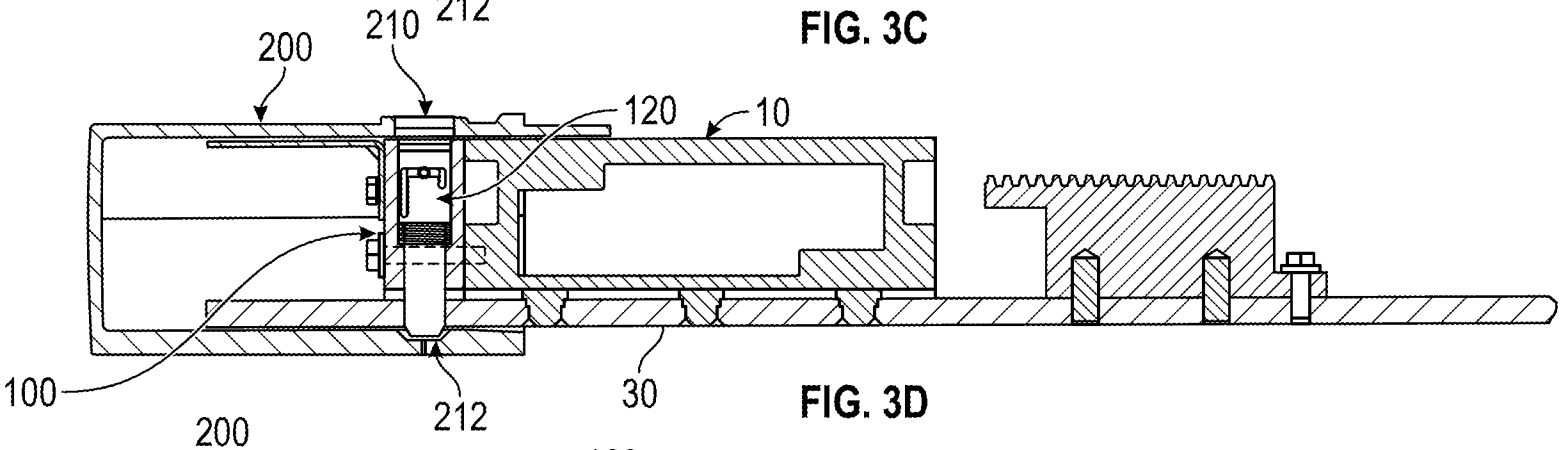
Figure 3E:
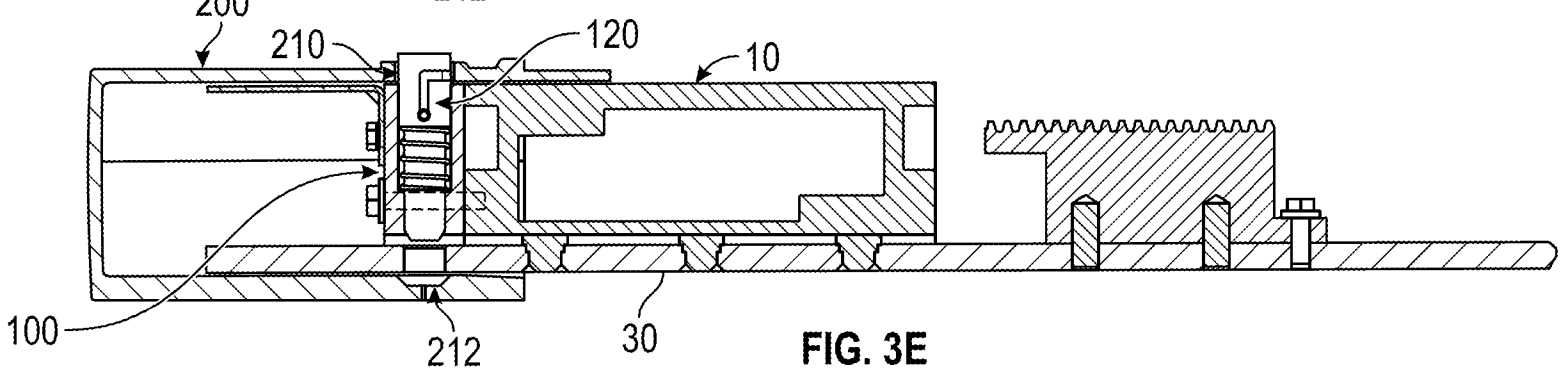
Figure 4:
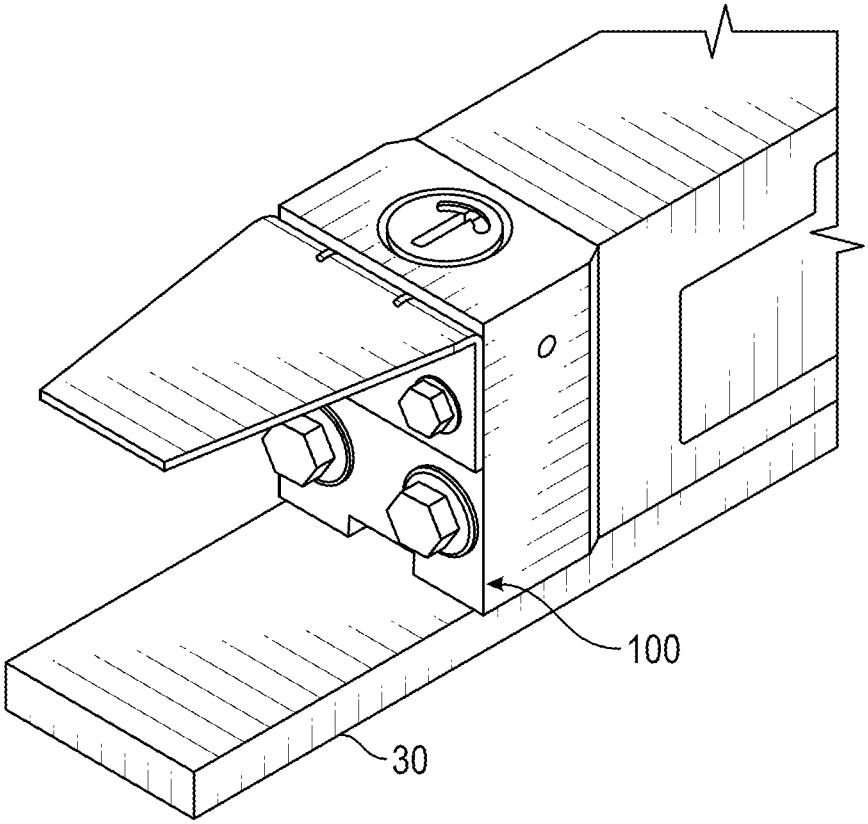
FIG. 4 is a further view of a locking mechanism including a test release mechanism in accordance with an example embodiment of the disclosed concept.

FIGS. 3A-E are additional views of the locking mechanism including the test release mechanism 100, and FIG. 4 is a closer view of the test release mechanism 100. The test release mechanism 100 includes a block 110, a lift pin 120, a spring 130, set screws 140, and fasteners 150. The test release mechanism 100 engages with the slide bar 30 via the lift pin 120 entering an opening 32 in the slide bar 30 and releases from the slide bar 30 by withdrawing the lift pin 120 from the opening 32. The test release mechanism 100 is fastened to the lock box 10 via the fasteners 150. In some example embodiments, the lock box 10 includes a channel 16 on its lower side which corresponds to protrusions 34 on the slide bar 30. The channel 16 and the protrusions 34 interact to prevent rotational movement of the lock box 10 with respect to the slide bar 30, but still allow linear movement of the lock box 10 along the slide bar 30 when the test release mechanism 100 is disengaged from the slide bar 30. A slide bar cover 200, including an opening 210 is also included. The slide bar cover 200 is a housing that receives the end of the slide bar 30 and the test release mechanism 100. The slide bar cover 200 also includes a cover 220, a latching mechanism 222, and a latching secure point 224 (shown in FIG. 12. The cover 220 is hinged so as to be movable to cover and uncover the opening 210 such that when the cover 220 is over the opening 210, the test release mechanism cannot be accessed and operated. The latching mechanism 222 and latching secure point 224 may be employed to lock the cover 220 in a position where it covers the opening 210 using a locking mechanism such as, for example and without limitation, a padlock or other similar device. It is to be noted that in some embodiments cover 220 includes a gasket to prevent the ingress of contaminants. When the lift pin 120 is aligned with the opening 210, the lift pin 120 may be moved upward through the opening 210, which in turn will release the test release mechanism 100 from the slide bar 30. When the lift pin 120 is not aligned with the opening 210, the lift pin 120 is prevented from moving upward, which prevents the test release mechanism 100 from releasing engagement with the slide bar 30. The position of the slide bar 30 where the lift pin 120 and the opening 210 are aligned may be a mid-throw position where the lock box 10 does not interfere with the lock rod 20. The guard 102 extends from the block 110 and blocks object from being inserted through the opening 210 when the opening 210 is not aligned with the lift pin 120.

In some example embodiments, the slide bar cover 200 includes a recess 212 in its bottom surface, aligned with the opening 210. When the lift pin 120 is arranged such that it has not yet completed its rotation, as is shown in FIG. 3D, the lift pin 120 extends into the recess 212, thus preventing movement of the slide bar 30 and the lock box 10 with respect to the slide bar cover 200. When the lift pin 120 is fully rotated to the position where it is engaged with the slide bar 30 (i.e., normal operation), as is shown in FIG. 3C, the lift pin 120 does not extend into the recess 212 and the slide bar 30 and lock box 10 can move in conjunction with respect to the slide bar cover 200. Similarly, when the lift pin 120 is fully rotated to the position where it is disengaged with the slide bar 30 (i.e., testing operation), as is shown in FIG. 3E, the lift pin 120 also does not extend into the recess 212 and the slide bar 30 and lock box 10 can move independently with respect to the slide bar cover 200. The lift pin 124 extending into the recess 212 between extents of its rotation provides a safety mechanism to restrain movement if the lift pin 124 has not been fully rotated to normal or testing positions.

FIGS. 3C-E show various stages of operation of the test release mechanism 100. In FIG. 3C, the lift pin 120 is aligned with the opening 210, but the cover 220 is covering the opening so that the lift pin 120 cannot be operated. In FIG. 3D, the cover 220 has been moved so it does not cover the opening 210. The lift pin 120 is also in the process of being operated, for example by a user. In FIG. 3E, operation of the lift pin 120 has been completed to rotate it to the released position, thus allowing its spring force to push it upward through the opening 210 such that the bottom end of the lift pin 120 disengages from the slide bar 30 and releases the test release mechanism 100 from engagement with the slide bar 30.

Figure 5A:
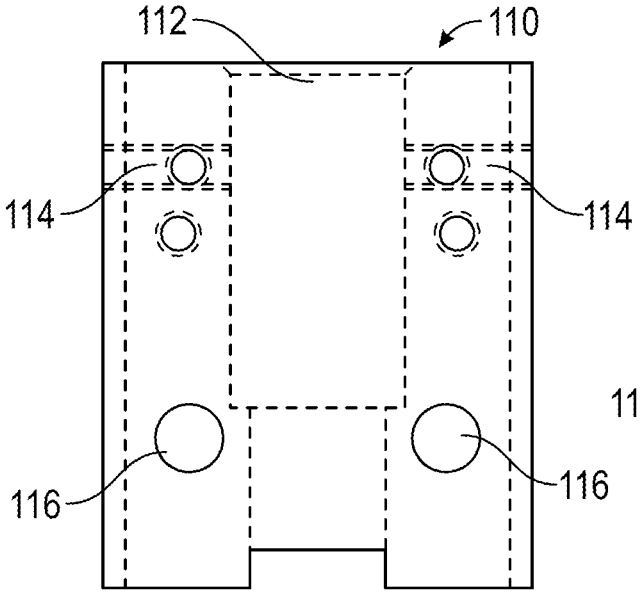
FIGS. 5A and 5B are views of a block of a test release mechanism in accordance with an example embodiment of the disclosed concept.
Figure 5B:
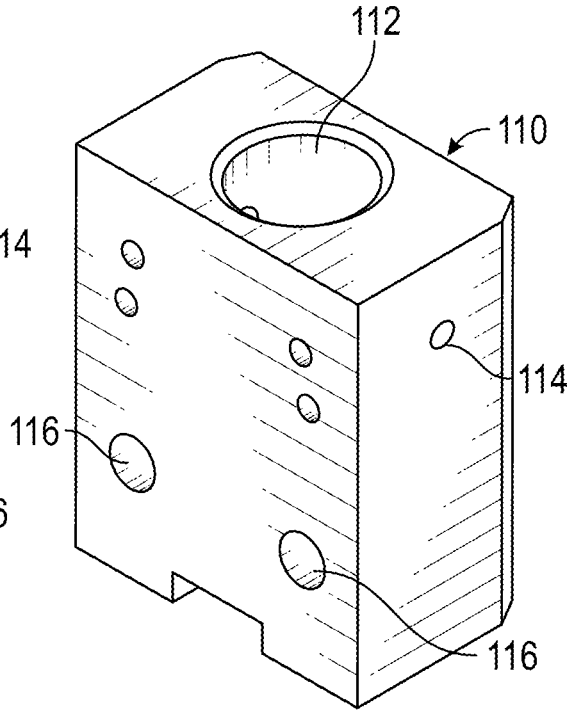

FIGS. 5A and 5B are views of the block 110 of the test release mechanism 100. The block 110 includes a large bore 112 extending from the top to the bottom of the block 110 and operable to receive the lift pin 120. The block 110 also includes small bores 114 extending from opposite sides of the block 110 into the large bore 112 and operable to receive the set screws 140. The block 110 further includes bores 116 extending from front to back sides of the block 110 and operable to receive the fasteners 150 that fasten the test release mechanism 100 to the lock box 10.

Figure 6C:
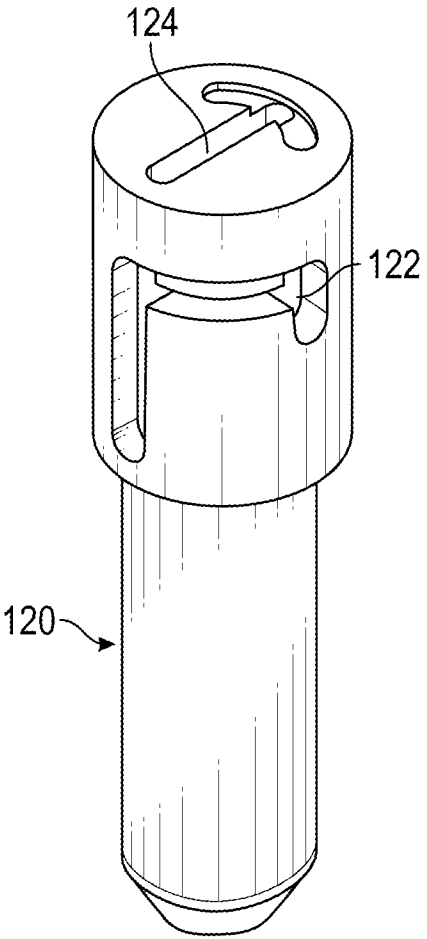
FIGS. 6A-C are views of a lift pin of a test release mechanism in accordance with an example embodiment of the disclosed concept.
Figure 6B:
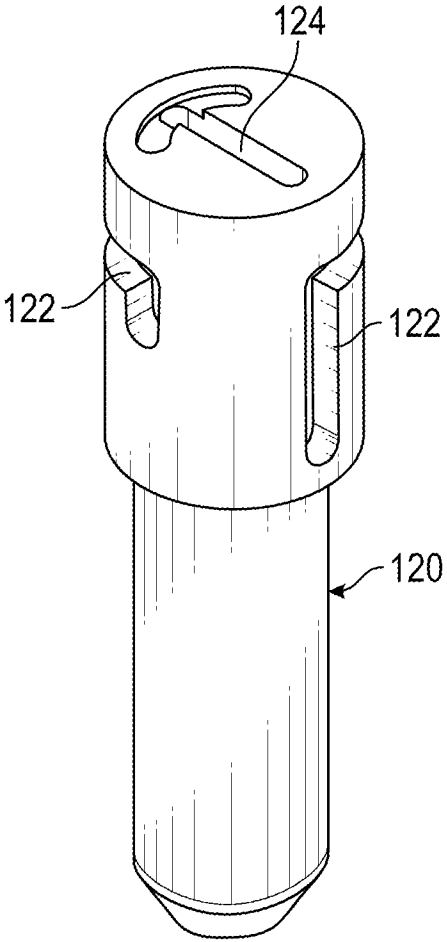
Figure 6A:
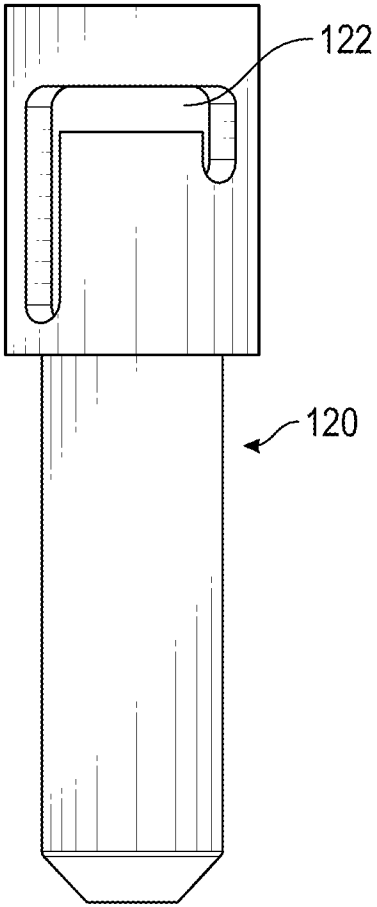

FIGS. 6A-C are views of the lift pin 120. The lift pin 120 includes a substantially cylindrical upper portion having a larger diameter than a substantially cylindrical lower portion. The large bore 112 of the block similarly includes a larger diameter upper portion and a smaller diameter lower portion such that the lower portion of the lift pin 120 can pass through the lower portion of the large bore 112 while the upper portion of the lift pin 120 cannot. When the test release mechanism 100 is assembled, the spring 130 is disposed around the lower portion of the lift pin 120. An upper side of the spring 130 abuts against the bottom of the upper portion of the lift pin 120 and a lower side of the spring 130 abuts against the top of the lower portion of the large bore 112. In this manner, the spring 130 biases the lift pin 120 upward.

The lift pin 120 is able to rotate within and move linearly through the large bore 112 of the block. Rotational and linear movement of the lift pin 120 is constrained by interaction between the set screws 140 and grooves 122 formed in the lift pin 120. The lift pin 120 includes two grooves 122 formed in it. The grooves 122 each have a long vertical portion, a short vertical portion, and a horizontal portion connecting the tops of the long and short vertical portions. The horizontal portion extends about 90 degrees around the circumference of the lift pin 120. The set screws 140 each enter one of the grooves 122 via the small bores 114 in the block 110. When the set screws 140 are in the long vertical portions of the grooves 122, the lift pin 120 is able to move further vertically and is able to withdraw from the opening 32 in the slide bar 30. The spring 130 biases the lift pin 120 upward so that the set screws 140 will rest at the bottom of the long vertical portions of the grooves 122, thus restricting rotation of the lift pin 120. When an operator pushes down the lift pin 120 against the bias of the spring 130, the lift pin 120 will move downward until the set screws 140 reach the horizontal portion of the grooves 122. From this position, the operator is able to rotate the lift pin 120 such that the set screws 140 are at the top of the short vertical portion of the grooves 122. Upon release of the downward force of the lift pin 120 in this position, the spring 130 will bias the lift pin upward such that the set screws 140 will rest at the bottom of the short vertical portion of the grooves 122, and rotational of the lift pin 120 will again be restricted. The short vertical portion of the grooves 122 restricts upward movement of the lift pin 120 such that it is not able to move vertically enough to withdraw from the opening 32 in the slide bar 30. In this manner, the operator is able to operate the test release mechanism 100 by pushing down, rotating, and releasing the lift pin 120 to engage or disengage the test release mechanism 100 from the slide bar 30.

An indicator groove 124 is provided on the top side of the lift pin 120 in order to assist an operator with manipulation of the lift pin 120. For example, an operator may insert a screwdriver or other device into the indicator groove 124 to push down and rotate the lift pin 120. In some example embodiments of the disclosed concept, the indicator groove 124 has an arrow shape, which can assist with indicating whether the lift pin 120 is positioned such that the set screws 140 are in the large vertical portion of the grooves 122, which would allow release from the slide bar 30, or in the short vertical portion of the grooves 122, which would not allow release from the slide bar 30. In an example embodiment of the disclosed concept, the indicator groove 124 has an arrow shape which, when pointed toward the lock box 10 indicates that the lift pin 120 is engaged with the slide bar 30 and normal operation. The arrow shape being pointed at a 90° with respect to the normal operation position indicated that the lift pin 120 is disengaged from the slide bar 30 and indicates that the test release mechanism 100 is in a testing position. While an example of one type of indicator groove 124 has been shown, it will be appreciated that the various other types of indication may be employed without departing from the scope of the disclosed concept.

Figure 7:
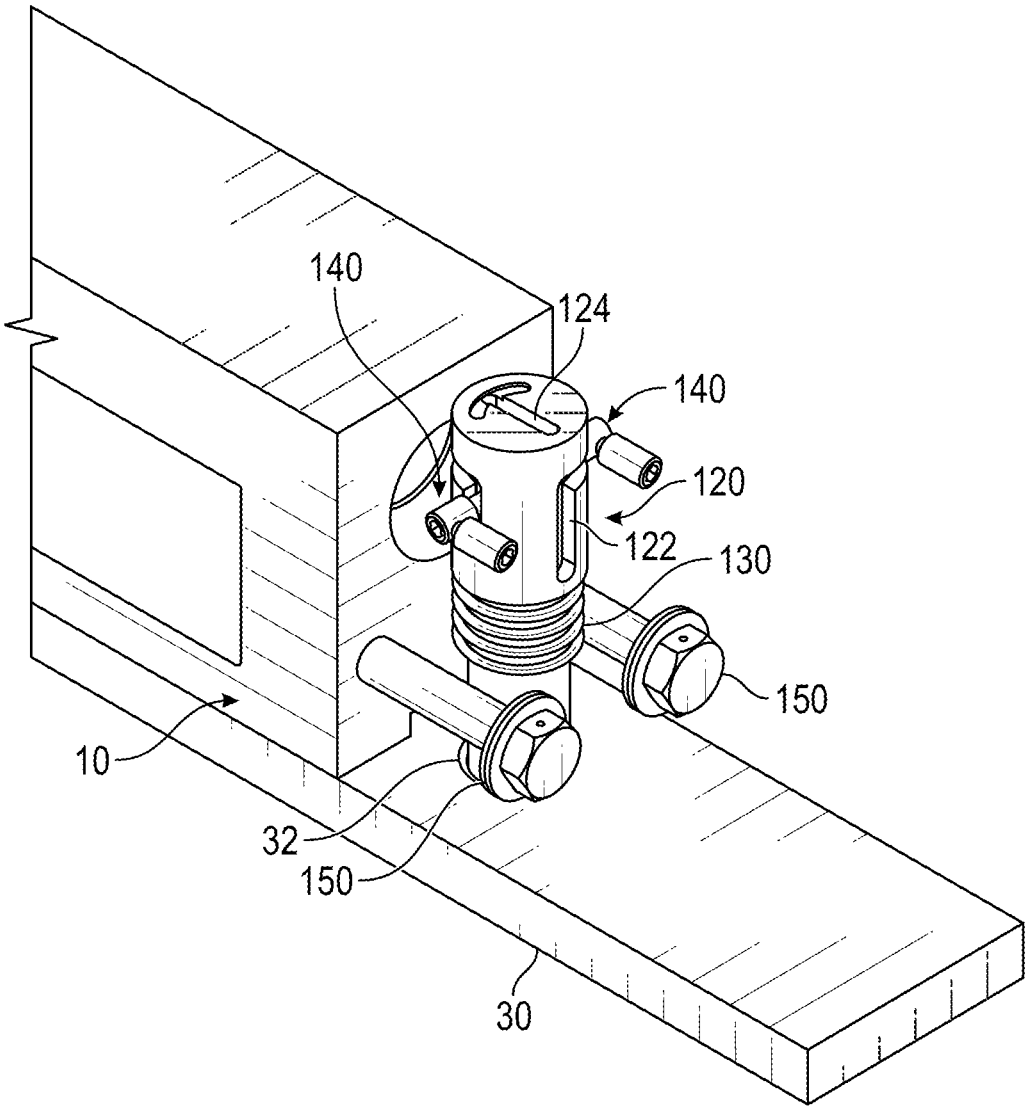
FIG. 7 is a view of a test release mechanism with the block hidden in accordance with an example embodiment of the disclosed concept.

FIG. 7 is a view of the test release mechanism 100 with the block 110 removed for purposes of illustration. As shown in FIG. 7, the set screws 140 are inserted into the grooves 122, thus restraining vertical and rotational movement of the lift pin 120.

FIGS. 8-11 illustrate the test release mechanism 100 in various stages of operation. The block 110 is hidden in these figures to aid in illustration of the operations, but it will be understood that the block 110 is included in the test release mechanism 100.

Figure 8:
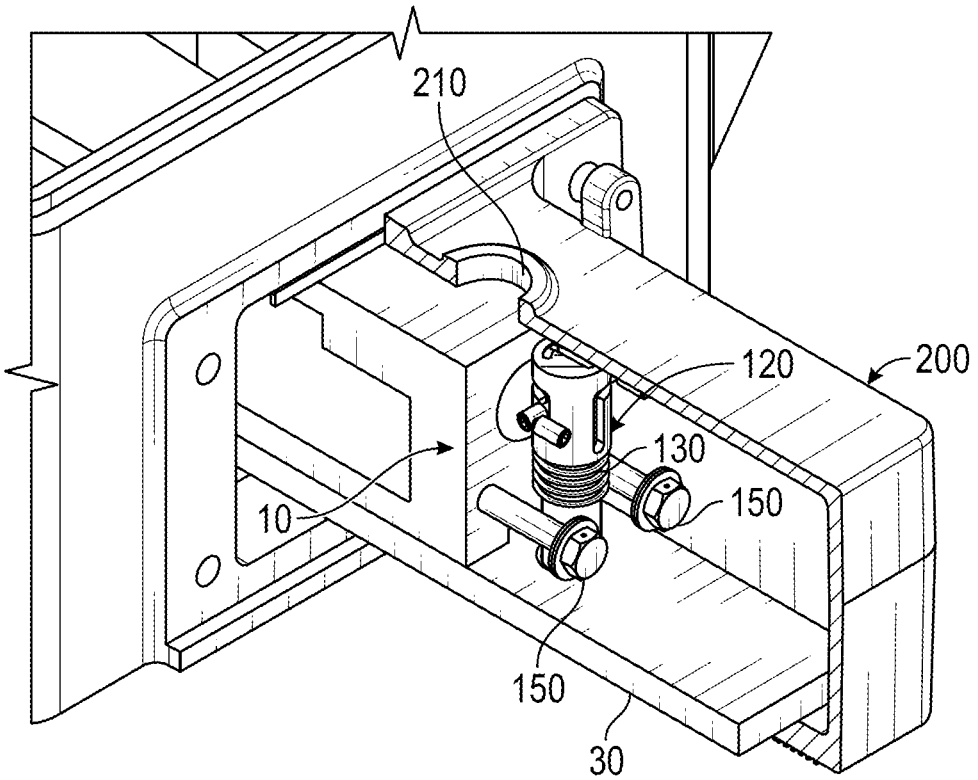
FIGS. 8-11 are views a test release mechanism in various stages of operation in accordance with an example embodiment of the disclosed concept.

In FIG. 8, the test release mechanism 100 is engaged with the slide bar 30 such that the test release mechanism 100 and lock box 10 move in conjunction with the slide bar 30. To release the test release mechanism 100 from the slide bar 30, the switch machine is first manually operated by a hand throw lever until the slide bar 30 moves to a position in which the lift pin 120 is aligned with the opening 210 of the slide bar cover 200. This aligned position may correspond to a mid-throw position where the lock box 10 will not interfere with the lock rod 20. This aligned position is shown in FIG. 9.

Figure 9:
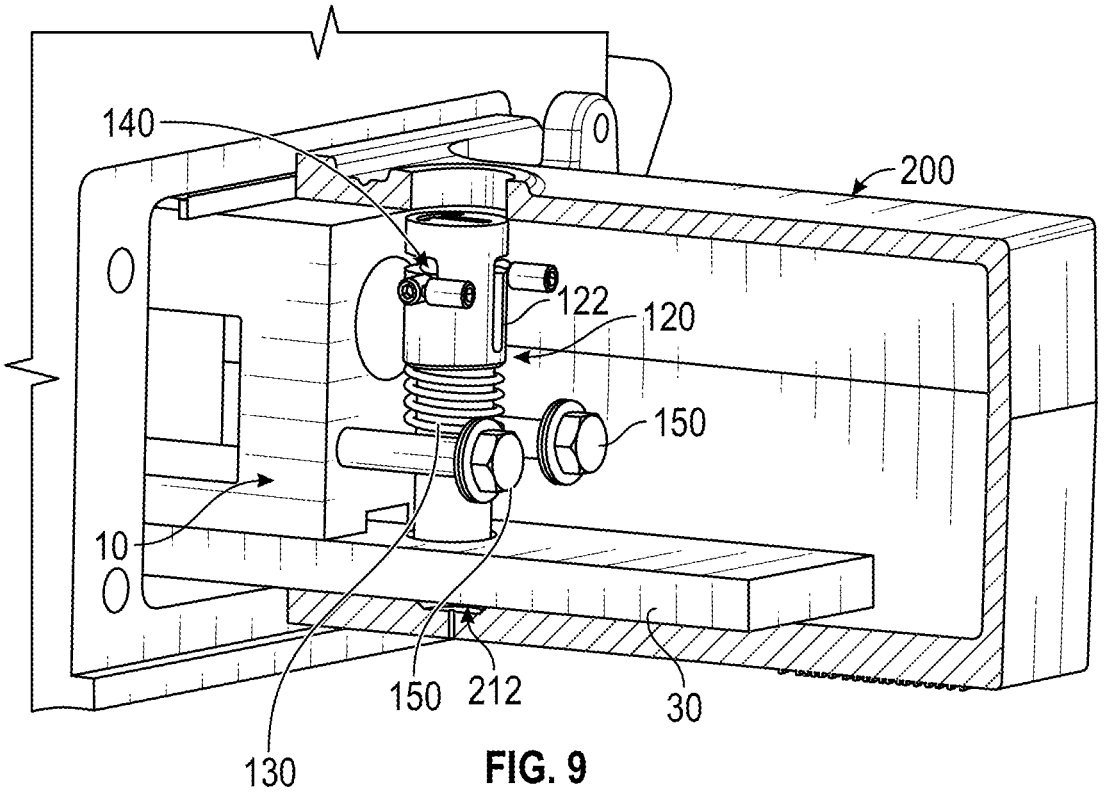
Figure 10:
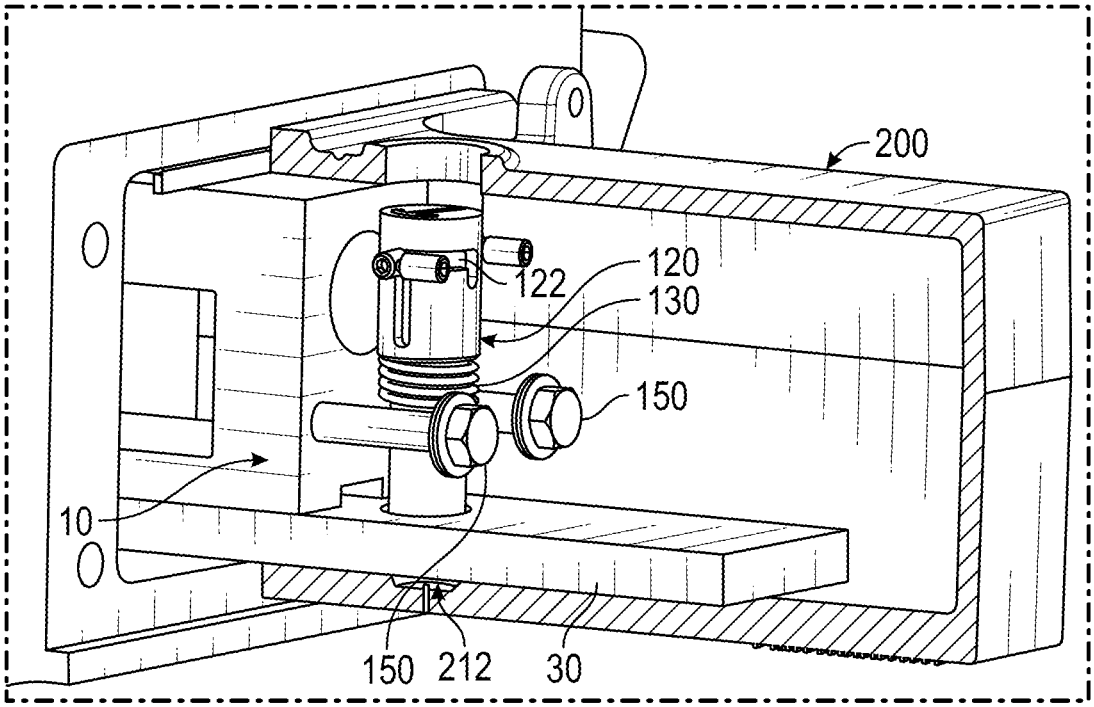
Figure 11:
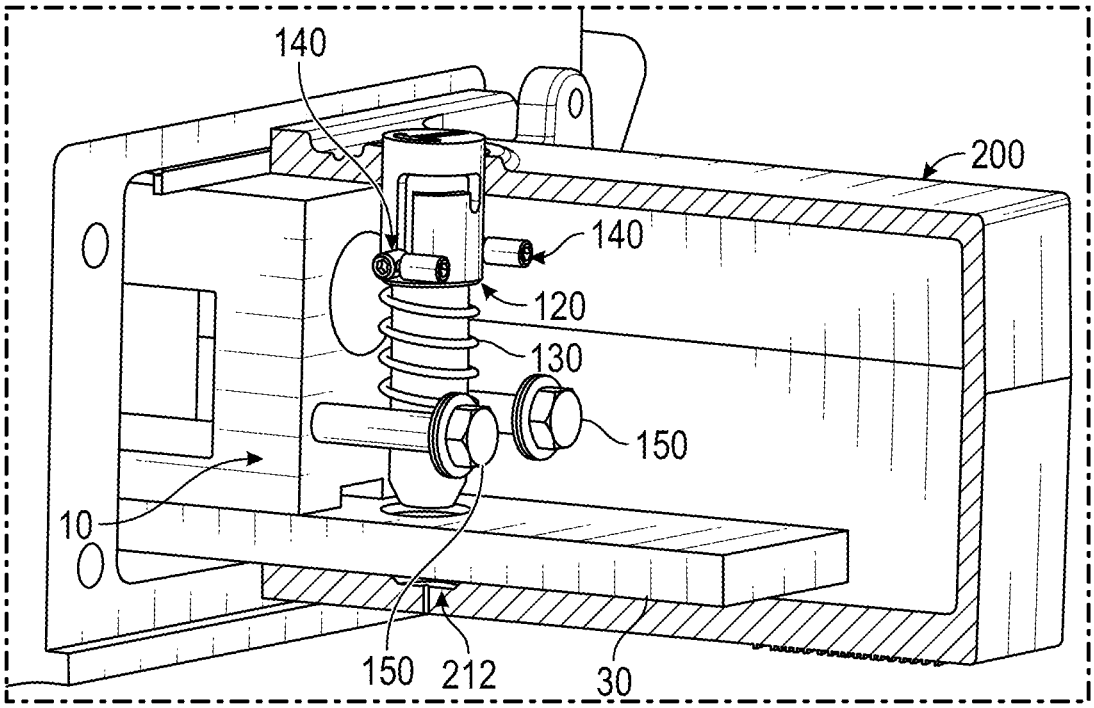
Figure 12:
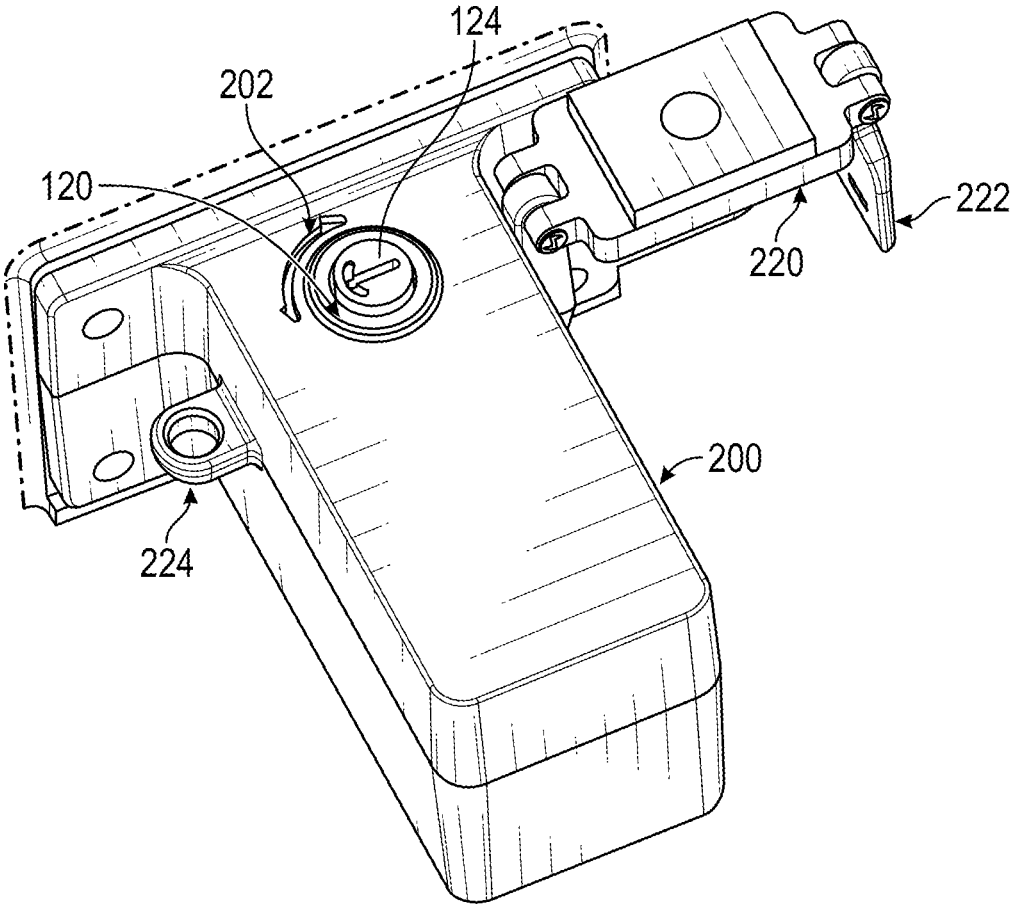
FIG. 12 is a view of a slide bar cover and a test release mechanism in accordance with an example embodiment of the disclosed concept.

As shown in FIG. 9, the set screws 140 are resting in the short vertical portion of the grooves 122 such that the upward movement of the lift pin 120 is restricted and it cannot withdraw from the slide bar 30. From the position shown in FIG. 9, an operator may insert a screwdriver or other mechanism through the opening 210 of the slide bar cover 200, push down the lift pin 120, and rotate it about 90 degrees such that the set screws 140 are at the top of the long vertical grooves, as is shown in FIG. 10. Then, the operator releases the downward pressure on the lift pin 120, and the spring 130 will bias the lift pin 120 upward, causing the set screws 140 to move to the bottom of the long vertical groove and causing the lift pin 120 to withdraw from the slide bar 30, as is shown in FIG. 11. Additionally, when the lift pin 120 withdraws from the slide bar 30, the top of the lift pin 120 will enter the opening 210 of the slide bar cover 200. An upper view of the lift pin 120 passing through the opening 210 of the slide bar cover 200 is also shown in FIG. 12. The interaction between the lift pin 120 and the opening 210 of the slide bar cover 200 will hold the test release mechanism 100 and attached lock box 10 in place, but the slide bar 30 will be able to move independent of them. From this position, testing of the point detection function of the switch machine can be completed without the lock box 10 interfering with the lock rod 20. Once the test is complete, the operator may then operate the switch machine to align the opening 32 of the slide bar 30 with the lift pin 120, push down the lift pin 120 into the opening of the slide bar 30, rotate it in the opposite direction about 90 degrees such that the set screws 140 are in the short vertical groove, and release it such that the lift pin 120 remains engaged with the slide bar 30 to resume normal switching operations.

The slide bar cover 200 and cover 220 also serves to prevent the lift pin 120 from moving vertically enough to withdraw from the slide bar 30 in the case that the lift pin 120 is inadvertently released. It is only when the lift pin 120 aligns with the opening 210 of the slide bar cover 200 that it will be able to move enough vertically to withdraw from the slide bar 30.

FIG. 12 shows an additional view of the slide bar cover 200 in accordance with an example embodiment of the disclosed concept. As previously described, the slide bar cover 200 includes a cover 220, latching mechanism 222, and latching secure point 224. In some example embodiments of the disclosed concept, the slide bar cover 200 may further include indicia 202 indicating whether the test release mechanism 100 is in a normal operation position (i.e., engaged with the slide bar 30) or a testing operation position (i.e., disengaged from the slide bar 30).

As described above, in accordance with an example embodiment of the disclosed concept, the test release mechanism 100 provides a quick and easy way to release the test release mechanism 100 and lock box 10 from the slide bar 30 so that the slide bar 30 can be moved independently of them to perform testing of the point detection function. Upon completion of the testing, the test release mechanism 100 and lock box 10 can quickly and easily be re-engaged with the slide bar 30 to resume normal operations.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A test release mechanism for a railway switch machine, the test release mechanism comprising:

a block structured to attach to a lock box in order to move in conjunction with the lock box; and a lift pin structured to be operable to selectively engage and disengage the block with a slide bar, wherein the lift pin is operable to insert into a corresponding opening of the slide bar to engage the block with the slide bar and to be removed from the corresponding opening of the slide bar to disengage the block from the slide bar.

2. The test release mechanism of claim 1, wherein the block includes a bore, and wherein the lift pin is disposed within the bore and is structured to move rotationally and linearly within the bore.

3. The test release mechanism of claim 1, further comprising:

a spring structured to bias the lift pin away from the slide bar.

4. The test release mechanism of claim 3, further comprising:

at least one set screw engaged with the block and the lift pin, wherein the lift pin includes a groove structured to receive the at least one set screw, wherein the groove includes a long vertical portion and a short vertical portion, wherein when the at least one set screw is disposed in the short vertical portion, the lift pin is prevented from moving out of the corresponding opening of the slide bar, and when the at least one set screw is disposed in the long vertical portion, the lift pin is able to move out of the corresponding opening of the slide bar.

5. The test release mechanism of claim 4, wherein the groove includes a horizontal portion connecting the long vertical portion and the short vertical portion such that linear and rotational movement of the lift pin allows the at least one set screw to move between the long vertical portion and the short vertical portion without the set screw disengaging from the lift pin.

6. The test release mechanism of claim 1, wherein the lift pin includes an indicator groove structured to indicate whether the lift pin is engaged or disengaged from the slide bar.

7. The test release mechanism of claim 1, further comprising:

a slide bar cover structured to house the block and the lift pin, the slide bar cover including an opening structured to receive the lift pin when the lift pin is aligned with the opening, and wherein the slide bar cover is structured to prevent the lift pin from disengaging with the slide bar when the lift pin is not aligned with the opening.

8. The test release mechanism of claim 7, wherein the slide bar cover includes a cover structured to selectively cover the opening and prevent the lift pin from disengaging with the slide bar when the slide bar cover selectively covers the opening.

9. The test release mechanism of claim 8, wherein the slide bar cover includes a latching mechanism structured to allow the cover to be locked in a position covering the opening.

10. The test release mechanism of claim 7, further comprising:

a guard extending from the block and structured to prevent an object from being inserted through the opening to an interior of the slide bar cover when the lift pin is not aligned with the opening of the slide bar cover.

11. The test release mechanism of claim 7, wherein the slide bar cover includes indicia to indicate whether the lift pin is engaged or disengaged from the slide bar.

12. The test release mechanism of claim 1, wherein the lift pin is structured to be operable when the slide bar is in a predetermined position, and wherein the lift pin is structured to be operated by being pushed down, rotated by a predetermined angle in a first direction, and released to selectively engage the lift pin with the slide bar and being pushed down, rotated by the predetermined angle in a second direction opposite the first direction, and release to selectively disengage the lift pin from the slide bar.

13. The test release mechanism of claim 1, further comprising:

at least one fastener structured to attach the block to the lock box.

14. A locking mechanism for a railway switch machine, the locking mechanism comprising:

a lock box;

a lock rod passing through the lock box;

a slide bar; and a test release mechanism including:

a block structured to attach to the lock box in order to move in conjunction with the lock box; and a lift pin structured to be operable to selectively engage and disengage the block with the slide bar.

* * * * *